US008403442B2

(12) United States Patent
Miyashita et al.

(10) Patent No.: US 8,403,442 B2
(45) **Date of Patent: *Mar. 26, 2013**

(54) PRINTING DEVICE AND PRINTING METHOD

(75) Inventors: Takahide Miyashita, Nagano (JP); Bunji Ishimoto, Nagano (JP); Tatsuo Furuta, Nagano (JP); Akito Sato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 95 days.

This patent is subject to a terminal disclaimer.

(21) Appl. No.: 13/078,071

(22) Filed: Apr. 1, 2011

(65) Prior Publication Data

US 2011/0261099 A1 Oct. 27, 2011

(30) Foreign Application Priority Data

Apr. 23, 2010 (JP) ..... 2010-100007
May 13, 2010 (JP) ..... 2010-110718

(51) Int. Cl.
*B41J 29/38* (2006.01)

(52) U.S. Cl. ..... 347/12

(58) Field of Classification Search ..... 347/9, 12, 347/40

See application file for complete search history.

(56) References Cited

U.S. PATENT DOCUMENTS 5,847,721 A 12/1998 Ogata et al.
8,075,081 B2 * 12/2011 Tatsuta ..... 347/19
2009/0091785 A1 4/2009 Yokouchi et al.
2011/0261100 A1 10/2011 Miyashita et al.

FOREIGN PATENT DOCUMENTS

JP 08-24423 A 9/1996
JP 08-244253 A 9/1996
WO WO-2007/116577 A1 10/2007

* cited by examiner

*Primary Examiner* — An Do
(74) *Attorney, Agent, or Firm* — Global IP Counselors, LLP

(57) ABSTRACT

A printing device is configured to print a first band in a first pass and to print a second band in a second pass so that the second band partially overlaps the first band for from an overlap printed area. The overlap printed area is divided by a single continuous boundary line into a first area that is printed during the first pass and a second area that is printed during the second pass. The boundary line includes a first boundary line portion where a parallel line extending parallel to a sub-scanning direction crosses the boundary line from the first area into the second area and a second boundary line portion where the parallel line crosses from the second area into the first area.

9 Claims, 13 Drawing Sheets

PRINTING DEVICE AND PRINTING METHOD

CROSS-REFERENCE TO RELATED APPLICATIONS

This application claims priority to Japanese Patent Application No. 2010-100007 filed on Apr. 23, 2010 and Japanese Patent Application No. 2010-110718 filed on May 13, 2010. The entire disclosures of Japanese Patent Application Nos. 2010-100007 and 2010-11-718 are hereby incorporated herein by reference.

BACKGROUND

1. Technical Field

The present invention relates to a printing device and a printing method.

2. Related Art

Band printing with a plurality of nozzles is one technique used when executing printing by an inkjet system. There are devices that, when doing so, print adjacent bands such that the boundaries thereof partially overlap, in order to prevent white streaks or density irregularities at boundaries between bands (Japanese Laid-Open Patent Application Publication No. 8-244253, for example).

SUMMARY

However, when the results are observed subsequent to printing, in some instances there are noticeable differences in color shading between printed portions in which bands overlap and printed portions with no overlap of bands.

It is accordingly an object of the present invention to address the above problem at least in part, and to avoid noticeable differences in color shading between printed portions in which bands overlap, and printed portions devoid of band overlap.

The present invention is directed to addressing the above problem at least in part through the following aspects or examples of application.

A printing device according to a first aspect is a printing device for executing band printing using a printing material. The printing device includes a print head having a plurality of nozzles, a main scanning direction drive mechanism configured and arranged to move the print head and a printing medium relative to each other in a main scanning direction during the band printing, a sub-scanning direction drive mechanism configured and arranged to move the print head and the printing medium relative to each other in a sub-scanning direction, and a control portion. The control portion is configured to execute partial overlap printing for printing an overlap printed area constituting a portion of each band in a plurality of main scanning passes, the overlap printed area being divided by a single continuous boundary line into a first area that is printed by upstream nozzles among the plurality of nozzles, and a second area that is printed by downstream nozzles among the plurality of nozzles. The boundary line includes a first boundary line portion where a parallel line extending parallel to the sub-scanning direction crosses the boundary line from the first area into the second area, and a second boundary line portion where the parallel line crosses from the second area into the first area. According to this aspect, because the boundary line includes a first boundary line portion where the parallel line crosses the boundary line from the first area into the second area, and a second boundary line portion where the parallel line crosses from the second area into the first area, if in one of the boundary line portions, the first area and the second area extend in a direction such a space therebetween is not printed, in the other boundary line portion, the first area and the second area overlap. As a result, it is possible to avoid noticeable differences in color shading between printed portions in which bands overlap and printed portions with no overlap of bands.

A printing device according to a second aspect is the printing device according to the first aspect, wherein the boundary line preferably has asperities with a low-frequency component and a high-frequency component with respect to the main scanning direction.

According to this aspect, it is possible for the high-frequency component to disperse continuity of the low-frequency component in the main scanning direction or a direction diagonal to the sub-scanning direction.

A printing device according to a third aspect is the printing device according to the second aspect, wherein an amplitude of the high-frequency component of the asperities is preferably smaller than an amplitude of the low-frequency component.

A printing device according to a fourth aspect is the printing device according to any of the first to third aspects, wherein the boundary line is preferably formed along a contour of a polygonal shape that is formed by a combination of a first triangle having a base side parallel to the main scanning direction, and a second triangle smaller than the first triangle and having as a base side a portion of an oblique side of the first triangle. According to this aspect, it is possible for the second triangles to disperse continuity of the first triangles in the main scanning direction or a direction diagonal to the sub-scanning direction.

A printing device according to a fifth aspect is the printing device according to the fourth aspect, wherein one of two oblique sides of the second triangle preferably intersects the main scanning direction at an angle of more than 0 degree and less than 45 degrees, while the other of the two oblique sides preferably intersects the main scanning direction at an angle of more than 45 degrees and less than 90 degrees. According to this aspect, streaks are unlikely to appear in the main scanning direction or in the sub-scanning direction.

A printing device according to a sixth aspect is the printing device according to the first aspect, wherein the boundary line preferably includes a Koch curve portion or a fractal shape portion. According to this aspect, because the Koch curve portion or the fractal shape has self-similarity, it is possible to disperse gaps and overlap between the first area and the second area.

A printing device according to a seventh aspect is the printing device according to any of the first to sixth aspects, wherein the boundary line preferably includes a portion where a second parallel line extending parallel to the main scanning direction crosses the boundary line from the first area into the second area, and a portion where the second parallel line crosses from the second area into the first area. According to this aspect, it is possible to avoid noticeable differences in color shading between printed portions in which bands overlap and printed portions with no overlap of bands, even if the first area and the second area further deviate in the main scanning direction.

A printing device according to an eighth aspect is a printing device for executing band printing using a printing material. The printing device includes a print head having a plurality of nozzles, a main scanning direction drive mechanism configured and arranged to move the print head and a printing medium relative to each other in a main scanning direction during the band printing, a sub-scanning direction drive mechanism configured and arranged to move the print head and the printing medium relative to each other in a sub-scanning direction, and a control portion. The control portion is configured to execute partial overlap printing for printing an overlap printed area constituting a portion of each band in a plurality of main scanning passes, the overlap printed area being divided by a single continuous boundary line into a first area that is printed by upstream nozzles among the plurality of nozzles, and a second area that is printed by downstream nozzles among the plurality of nozzles. The boundary line includes a first boundary line portion where a parallel line extending parallel to the main scanning direction crosses the boundary line from the first area into the second area, and a second boundary line portion where the parallel line crosses from the second area into the first area. According to this aspect, it is possible to avoid noticeable differences in color shading between printed portions in which bands overlap and printed portions with no overlap of bands, even if the first area and the second area deviate in the main scanning direction.

A printing method according to a ninth aspect includes: printing a first band in a first pass; and printing a second band in a second pass so that the second band partially overlaps the first band for from an overlap printed area. The overlap printed area being divided by a single continuous boundary line into a first area that is printed during the first pass and a second area that is printed during the second pass, the boundary line including a first boundary line portion where a parallel line extending parallel to a sub-scanning direction crosses the boundary line from the first area into the second area and a second boundary line portion where the parallel line crosses from the second area into the first area.

The present invention may be embodied in various other aspects besides a printing device, for example, a printing method, a band mask, or the like.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
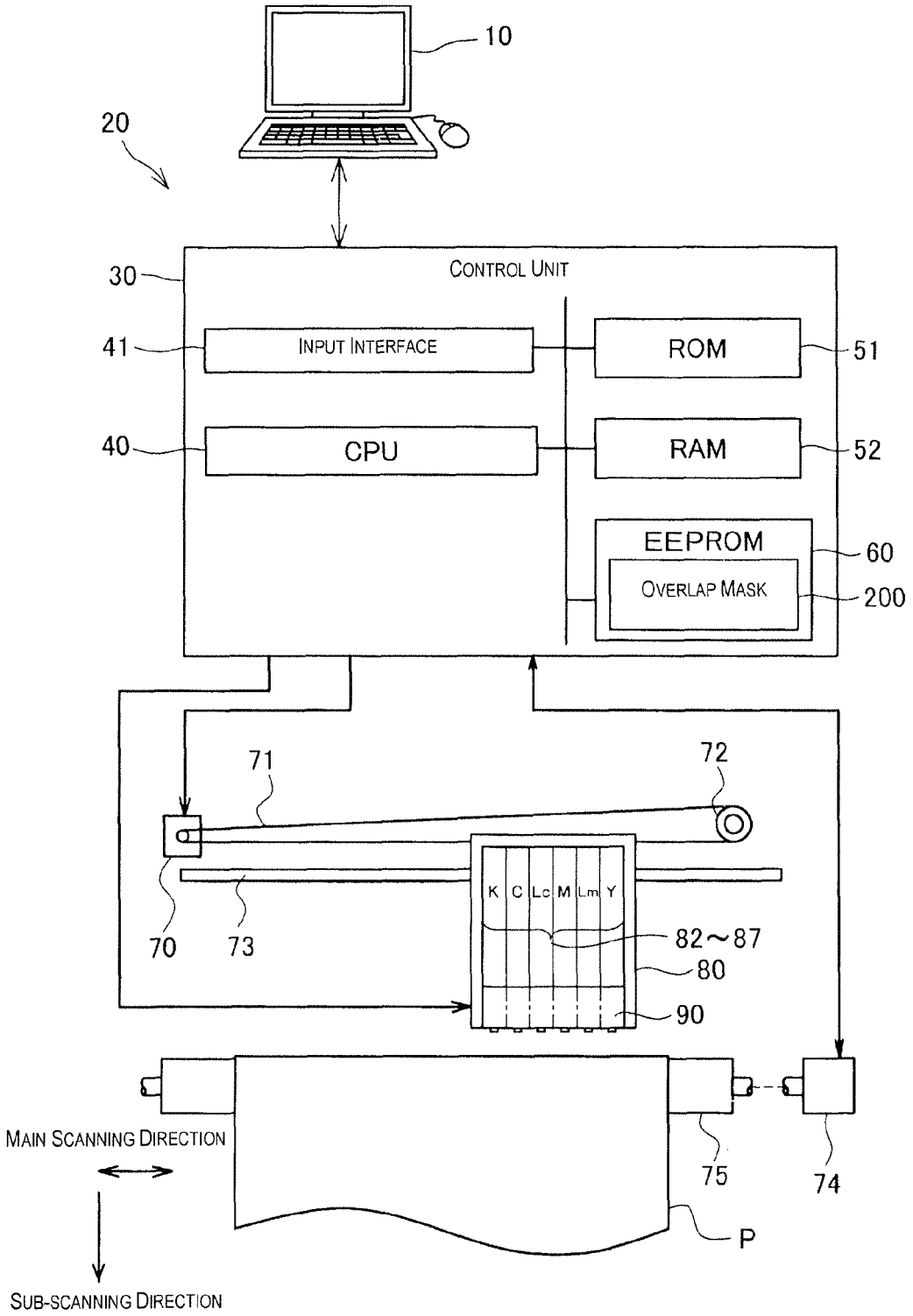
FIG. 1 is a drawing showing a configuration of a printing system.

FIG. 1 is a drawing showing a configuration of a printing system. The printing system includes a computer 10 and a printer 20. The computer 10 generates print data for the printer 20, and sends it to the printer 20. The printer 20 is a serial inkjet printer, and includes a control unit 30, a carriage motor 70, a drive belt 71, a pulley 72, a slide rail 73, a paper feed motor 74, a paper feed roller 75, a carriage 80, ink cartridges 82 to 87, and a print head 90.

The control unit 30 includes a CPU 40, an input interface 41, a ROM 51, a RAM 52, and an EEPROM 60. Optionally, the control unit 30 may employ flash memory instead of the EEPROM 60. The EEPROM 60 stores a partial overlap mask 200. The CPU 40 loads into the RAM 52 a program that is stored in the ROM 51 or in the EEPROM 60, and executes the program to control general operation of the printer 20. The input interface 41 receives print data from the computer 10.

The drive belt 71 stretches between the carriage motor 70 and the pulley 72. A carriage 80 is mounted on the drive belt 71. On the carriage 80 there are installed ink cartridges 82 to 87 for colored inks, which respectively contain as color inks cyan ink (C), magenta ink (M), yellow ink (Y), black ink (K), light cyan ink (Lc), and light magenta ink (Lm). On a print head 90 at the bottom of the carriage 80 there are formed rows of nozzles corresponding to the color inks of the colors mentioned above. With these ink cartridges 82 to 87 installed from above into the carriage 80, it is possible to supply ink to the print head 90 from the cartridges. The slide rail 73 is disposed parallel to the drive belt, and passes through the carriage 80.

As the carriage motor 70 drives the drive belt 71, the carriage 80 moves along the slide rail 73. This direction is referred to as the "main scanning direction." In association with movement of the carriage 80 in the main scanning direction, the ink cartridges 82 to 87 and the print head 90 also move in the main scanning direction. During movement in this main scanning direction, printing onto a printing medium P is carried out by ejecting the ink inside the ink cartridges 82 to 87 onto the printing medium P from print nozzles (described below) arranged on the print head 90. A single main scan is termed a "pass."

The paper feed roller 75 is connected to the paper feed motor 74. During printing, the printing medium P is passed over the top of the paper feed roller 75. As the carriage 80 moves to the end position in the main scanning direction, the control unit 30 rotates the paper feed motor 74. By so doing, the paper feed roller 75 rotates as well, moving the printing medium P. The direction of this relative motion of the printing medium P and the print head 90 is termed the "sub-scanning direction."

Figure 2:
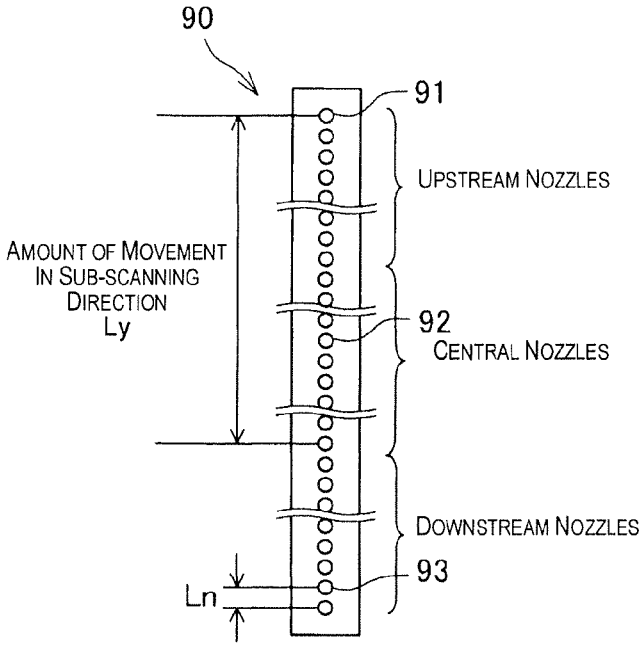
FIG. 2 is a drawing showing a nozzle row of a print head.

FIG. 2 is a drawing showing a nozzle row of a print head. The nozzle row shown in FIG. 2 is for a single color. In the present embodiment, because there are six colors, the printer 20 is provided with one nozzle row like that shown in FIG. 2 for each color, for a total of six rows. The nozzle row has a plurality of upstream nozzles 91, a plurality of central nozzles 92, and a plurality of downstream nozzles 93. The upstream nozzles 91 and the downstream nozzles 93 are nozzle groups that are used during overlap printing, and contain the same number of nozzles. The nozzle pitch Ln of the nozzles 91 to 93 is identical to the pitch of the pixel rows during printing. The amount of movement Ly of the printing medium P in the sub-scanning direction is a length equal to the sum of the length of the portion of the upstream nozzles 91 and the length of the portion of the central nozzles 92.

Figure 3:
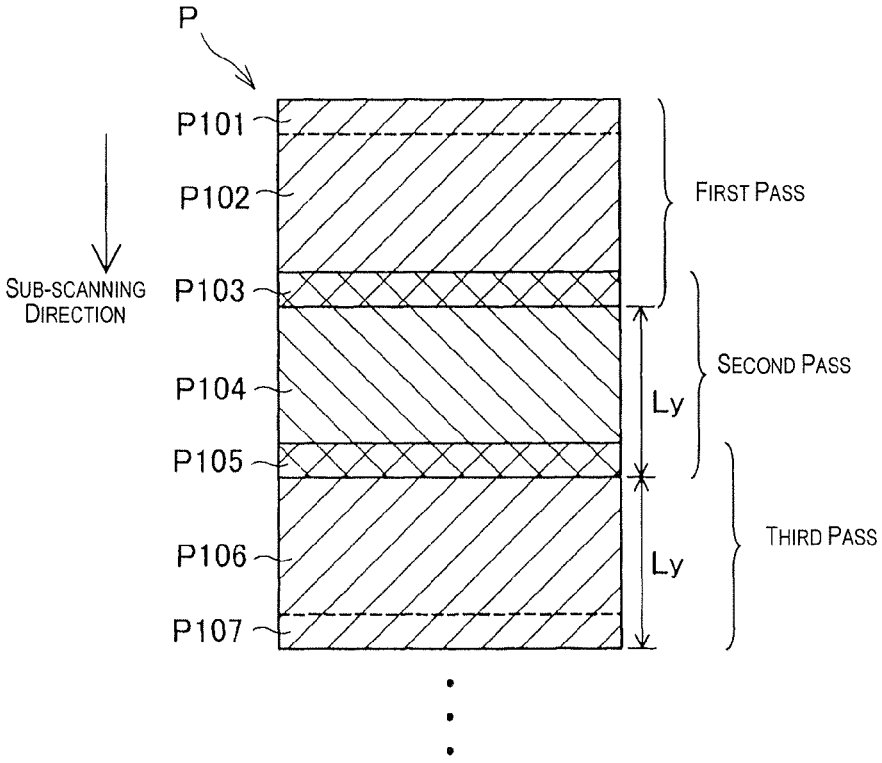
FIG. 3 is a drawing showing partial overlap printing.

FIG. 3 is a drawing showing partial overlap printing. In a first pass, the printer 20 prints areas P101 to P103 onto the printing medium P. Here, the area P101 is an area that is printed by the upstream nozzles 91, the area P102 is an area that is printed by the central nozzles 92, and the area P103 is an area that is printed by the downstream nozzles 93. Once printing of the first pass is completed, the printer 20 moves the printing medium P by Ly in the sub-scanning direction, and in a second pass prints areas P103 to P105. In the second pass, the area P103 is an area that is printed by the upstream nozzles 91, the area P104 is an area that is printed by the central nozzles 92, and the area P105 is an area that is printed by the downstream nozzles 93. Specifically, a portion of the area P103 is printed by the downstream nozzles 93 in the first pass, while the remaining portion is printed by the upstream nozzles 91 in the second pass. The areas P102 and P104, on the other hand, are printed by the central nozzles 92 exclusively. Moving the printing medium P or the print head in the sub-scanning direction and printing successive passes, doing so with partial overlap within ranges in the sub-scanning direction in this manner, is called "partial overlap printing," and an area that is printed in the course of multiple passes is termed an "overlap area." An area printed during a single pass is also termed a "band." For example, the areas P103 to P105 correspond to one "band," while the areas P103 and P105 respectively correspond to "overlap areas." Similarly, during the third pass, the areas P105 to P107 are printed and the area P105 is printed with overlap; and during the fourth pass (not shown), the area P107 is printed with overlap. Areas printed by the upstream nozzles 91 and the downstream nozzles are printed in the course of two passes, while areas printed by the central nozzles 92 are printed in the course of a single pass only. However, the area that is printed by the upstream nozzles 91 during the initial pass over the printing medium P and the area printed by the downstream nozzles 93 during the final pass are printed in the course of a single pass only.

Figure 4:
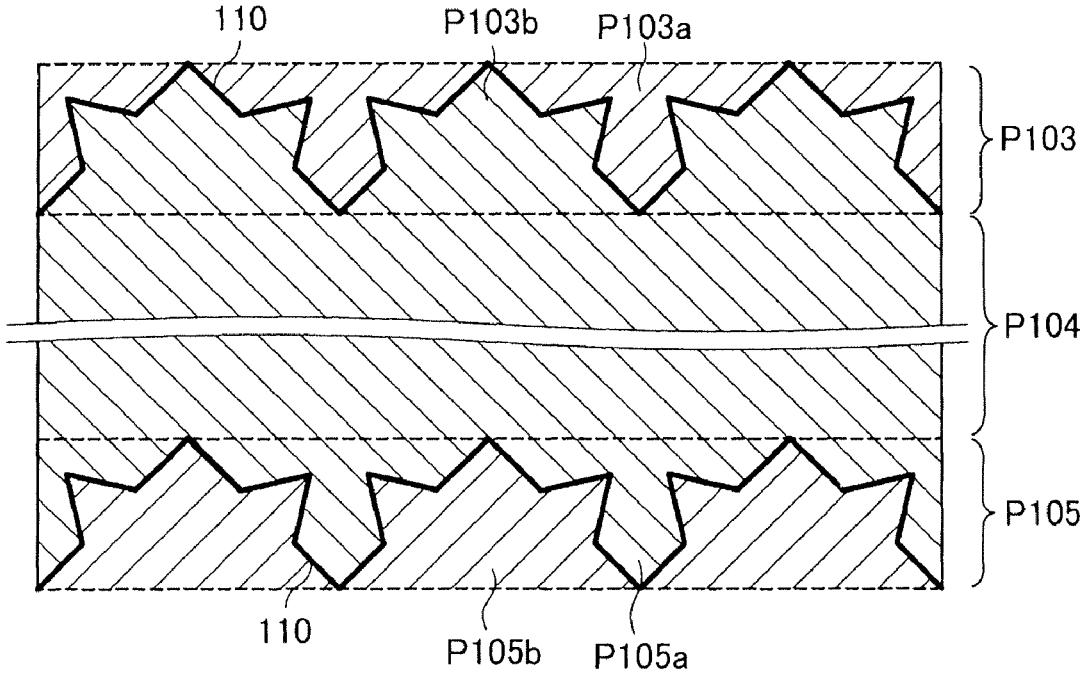
FIG. 4 is a drawing showing an enlarged section of FIG. 3.

FIG. 4 is a drawing showing an enlarged section of FIG. 3. In FIG. 4, areas P103 and P105 are printed with partial overlap. The area P103 can be divided by a boundary line 110 into a first partial area 103*a* that is printed by the downstream nozzles 93, and a second partial area 103*b* that is printed by the upstream nozzles 91. There is no overlap of the first partial area 103*a* and the second partial area 103*b*. Similarly, the area P105 can be divided into a first partial area 105*a* and a second partial area 105*b*.

Figure 5:
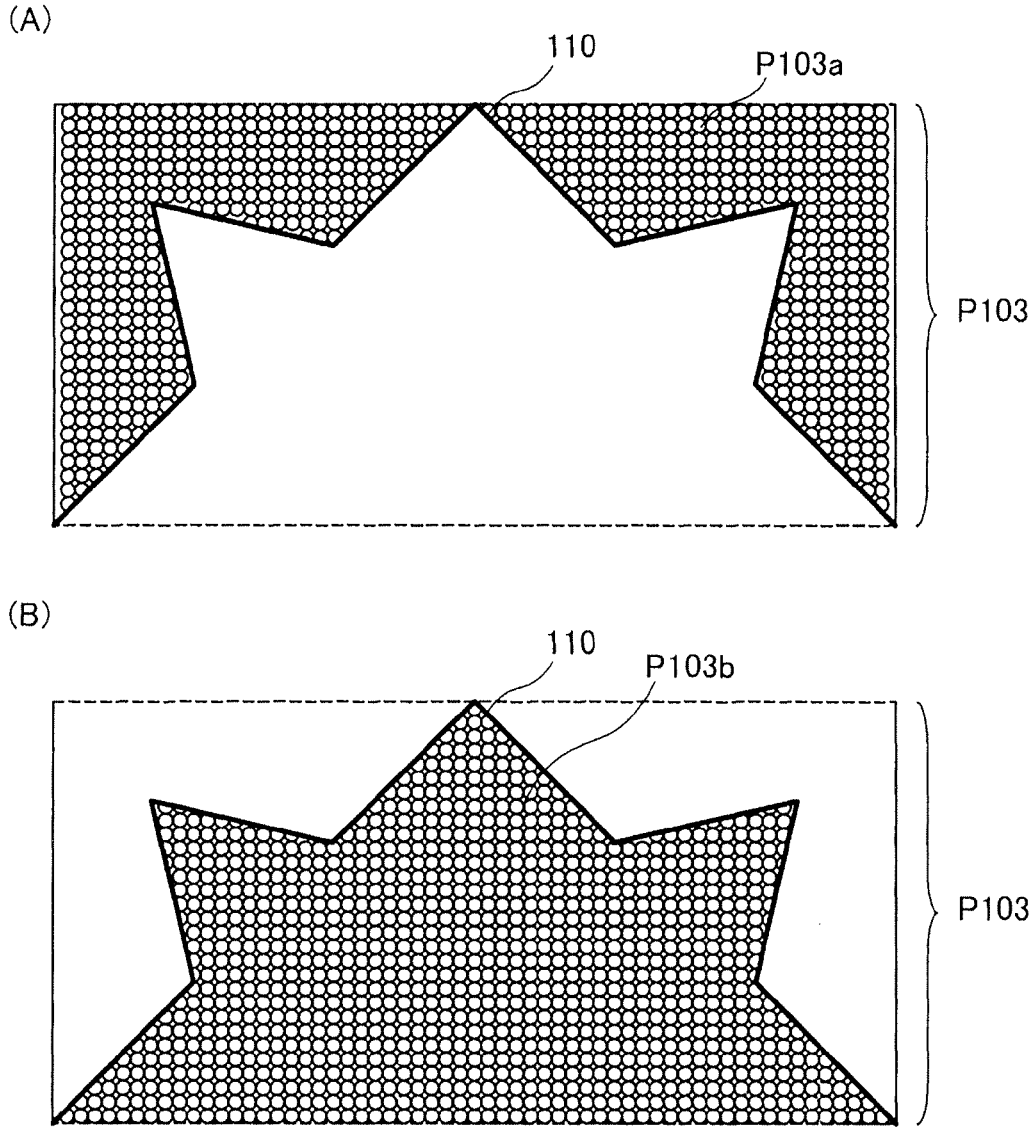
FIG. 5 is a drawing showing pixel rows in a portion printed by upstream nozzles and in a portion printed by downstream nozzles in an area P103.

FIG. 5 is a drawing showing pixel rows in a portion printed by upstream nozzles and in a portion printed by downstream nozzles in the area P103. FIG. 5 (A) shows the partial area 103*a* that is printed by the downstream nozzles 93, and FIG. 5 (B) shows the partial area 103*b* that is printed by the upstream nozzles 91. In the area P103, the upper side of the boundary line 110 in the drawing is the partial area 103*a* that is printed by the downstream nozzles 93, and the lower side thereof in the drawing is the partial area 103*b* that is printed by the upstream nozzles 91.

Figure 6:
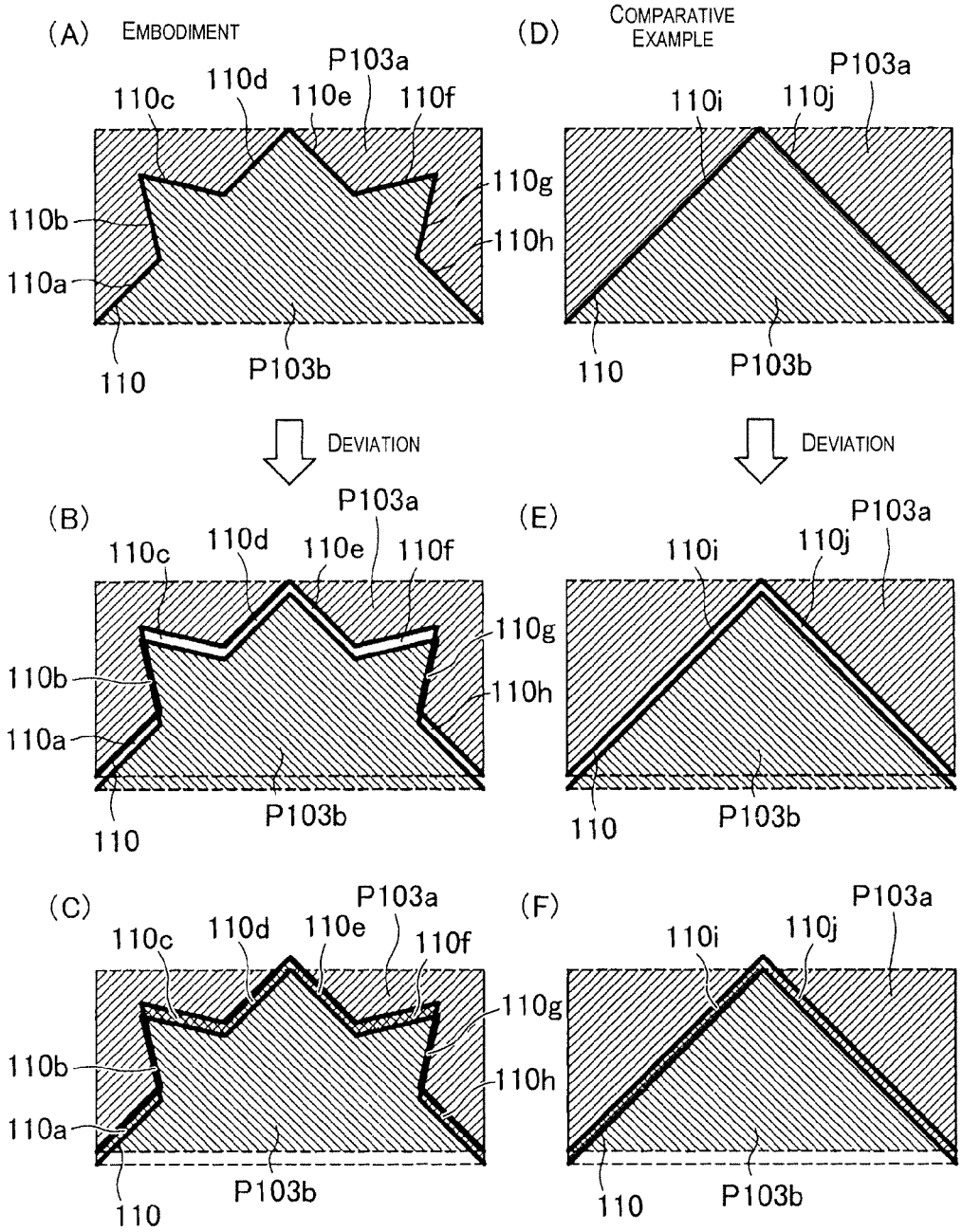
FIG. 6 is a drawing showing instances of deviation in the sub-scanning direction of the band of a first pass and the band of a second pass.

FIG. 6 is a drawing showing instances of deviation in the sub-scanning direction of the band of a first pass and the band of a second pass. FIG. 6 (A) to (C) depict the present embodiment, and FIG. 6 (D) to (F) depict a comparative example. According to the present embodiment, the boundary line 110 between the area P103*a* and the area P103*b* is composed of line segments 110*a* to 110*h*, and forms an approximately star shape. In the comparative example, on the other hand, the boundary line 110 is composed of line segments 110*i*, 110*j*, and forms oblique sides of a triangle. FIG. 6 (B) and FIG. 6 (E) depict instances where the second pass has relative deviation in comparison with the first pass in the sub-scanning direction (the downward direction in the drawing). As mentioned previously, movement in the sub-scanning direction is accomplished by the paper feed roller 75. For this reason, deviations may occur if there is a difference in friction between the paper feed roller 75 and the printing medium P. In the comparative example shown in FIG. 6 (E), unprinted gap portions are produced in portions of the line segments 110*i*, 110*j*. In the present embodiment shown in FIG. 6 (B), on the other hand, while gap portions are produced in portions of the line segments 110*a*, 110*c*, 110*d*, 110*e*, 110*f*, and 110*h*, portions of the line segments 110*b*, 110*g* are printed overlapping. For example, in a case where the printing medium P has been printed with a single color, in the comparative example, due to their large size the gap portions appear as white streaks in the area P103, or the area P103 appears lighter in comparison with the area P102 or the area P104. In the present embodiment, on the other hand, while gap portions are produced in portions of the line segments 110*a*, 110*c*, 110*d*, 110*e*, 110*f*, and 110*h*, because areas printed overlapping are produced in portions of the line segments 110*b*, 110*g*, when viewed from a distance the gap portions and the overlapping portions cancel out, making it less likely that the area P103 will appear lighter in comparison with the area P102 or the area P104. Specifically, the area P103 appears to be substantially identical in color to the area P102 or the area P104.

FIG. 6 (C) and FIG. 6 (F) depict instances of deviation of the second pass relative to the first pass in the sub-scanning direction. In the comparative example shown in FIG. (F), portions of the line segments 110*i*, 110*je* are printed overlapping. Consequently, the area P103 appears darker in comparison with the area P102 or the area P104. In the present embodiment, on the other hand, portions of the line segments 110*a*, 110*c*, 110*d*, 110*e*, 110*f*, and 110*h* are printed overlapping, but gap portions are produced in portions of the line segments 110*b*, 110*g*. Specifically, it is unlikely that the area P103 will appear to be darker in comparison with the area P102 or the area P104. Specifically, the area P103 appears to be substantially identical in color to the area P102 or the area P 104.

Figure 7:
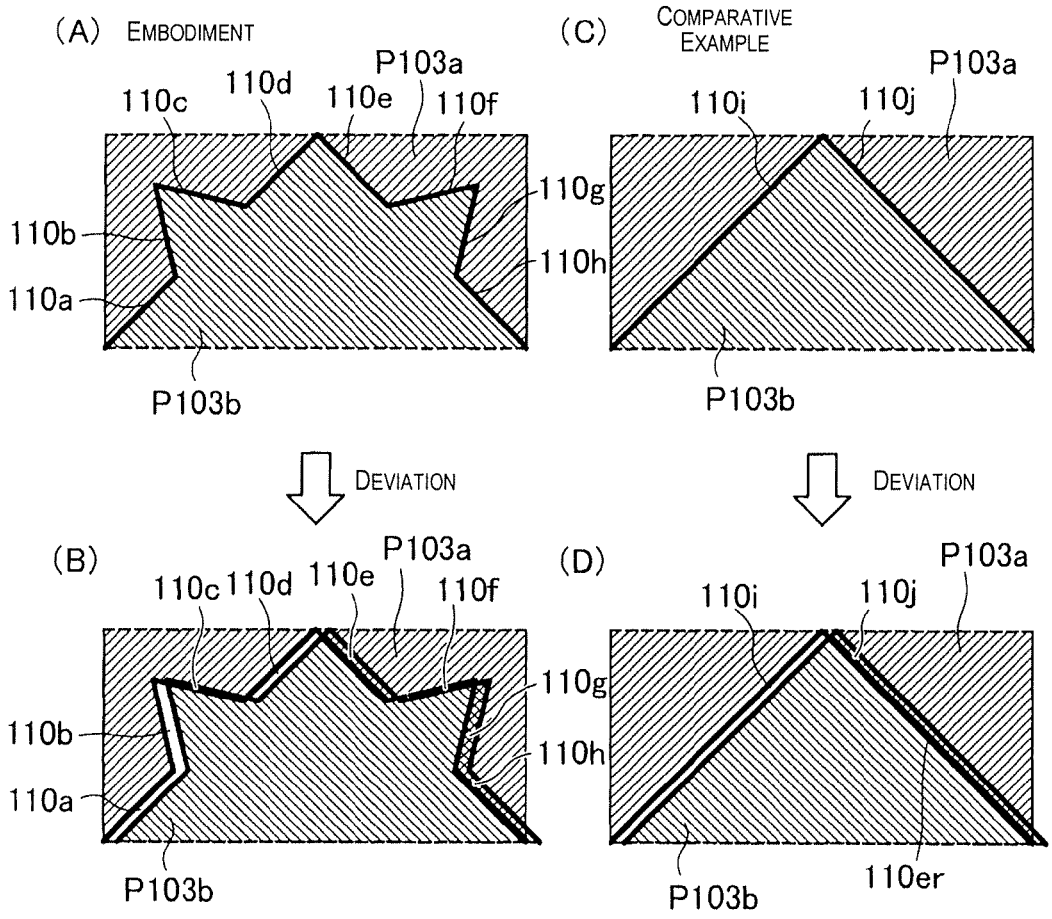
FIG. 7 is a drawing showing instances of deviation in the main scanning direction of bands of a first pass and of a second pass.

FIG. 7 is a drawing showing instances of deviation in the main scanning direction of the band of a first pass and the band of a second pass. FIGS. 7 (A) and (C) are identical to FIGS. 6 (A) and (D). FIG. 7 (B) and FIG. 7 (D) depict instances of deviation of the second pass relative to the first pass in the main scanning direction. In this case, in the comparative example, an unprinted gap is produced in the portion of the line segment 110*e*1 on the left side, while the portion of the line segment 110*er* on the right side is printed overlapping. In the present embodiment, on the other hand, gaps are produced in the portions of the line segments 110*a*, 110*b*, 110*d*, and 110*f*, while the portions of the line segments 110*c*, 110*e*, 110*g*, and 110*h* are printed overlapping. Comparing the two, in the present embodiment, the unprinted gap portions and the overlap printed portions appear at shorter periodicity in the main scanning direction. As a result, in the present embodiment, the area P103 is more likely to appear to be substantially identical in color to the area P102 or the area P104.

Figure 8A:
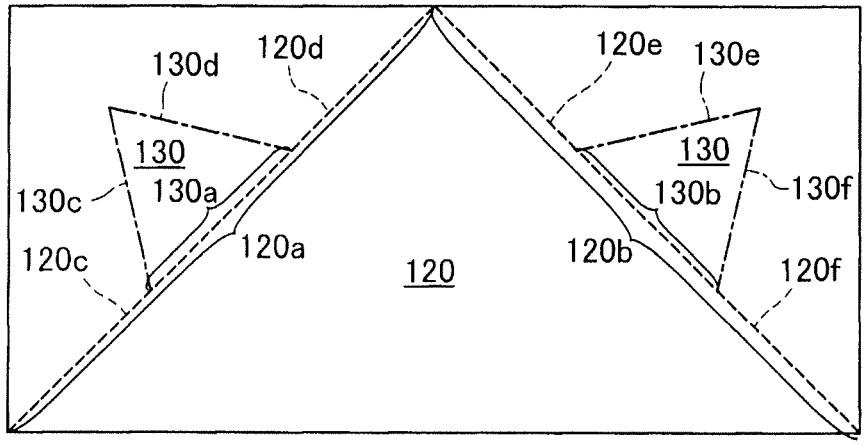
FIGS. 8A and 8B are drawings showing features of a boundary line on a printing medium.
Figure 8B:
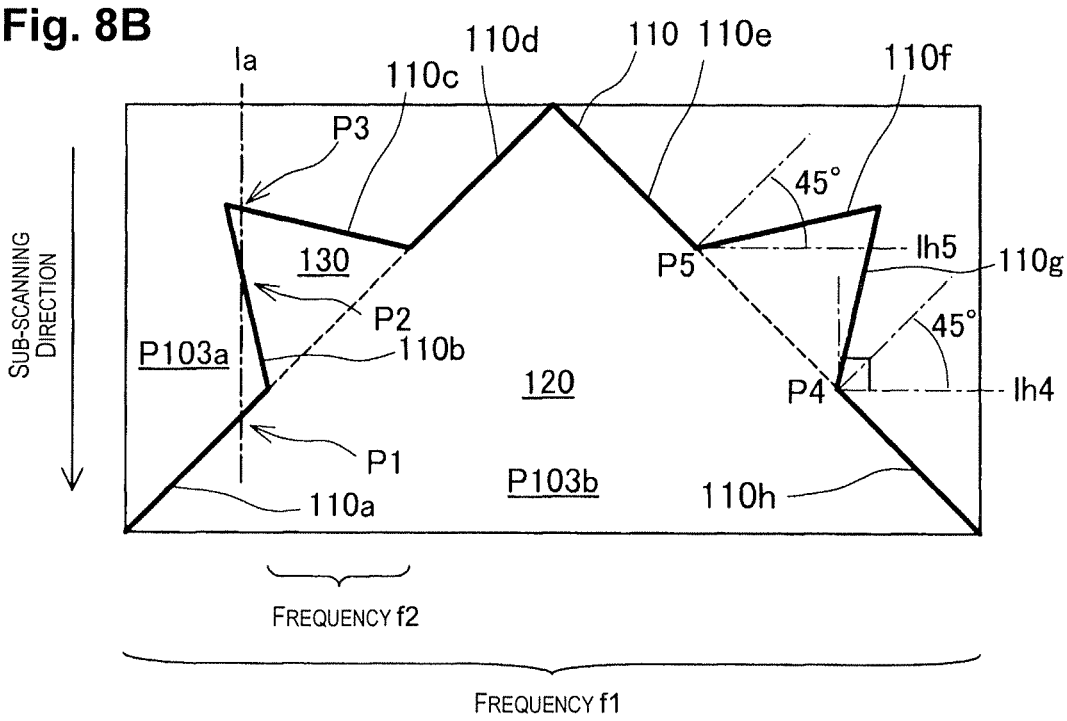

FIGS. 8A and 8B are drawings showing features of a boundary line on a printing medium. FIG. 8A is a simple depiction of a configuration example for a boundary line 110. A second triangle 130 has a base side 130*a* that is situated on an oblique side 120*a* of a first triangle 120, and another second triangle 130 has a base side 130*b* that is situated on an oblique side 120*b* of the first triangle 120. The boundary line 110 is formed along generally star shaped contours defined by portions of oblique sides that belong to the two triangles 120, 130 but that do not overlap sides of other triangles 120, 130 (i.e., line segments 120*c*, 130*c*, 130*d*, 120*d*, 120*e*. 130*e*, 130*f*, and 1200. The line segments 120*c*, 130*c*, 130*d*, 120*d*, 120*e*, 130*e*, 130*f*, and 120*f* respectively correspond to the line segments 110*a* to 110*h* of the boundary line 110. Or, the boundary line 110 is formed along polygonal contours defined by a combination of a first triangle 120, and second triangles 130 that are smaller than the first triangle 120 and that have portions of the oblique sides 120*a*, 120*b* of the first triangle 120 as a base side.

FIG. 8B shows features of a boundary line. A line 1*a* is drawn parallel to the sub-scanning direction on the printing medium P. Of the line segments 110*a* to 100*d* that make up the boundary line 110, this parallel line 1*a* intersects line segments 110*a* to 110*c* at points P1 to P3 respectively. At points P1 and P3, the line 1*a* crosses the boundary line 110 from the second partial area 103*b* into the first partial area 103*a*. At point P2, the line 1*a* crosses the boundary line 110 from the first partial area 103*b* into the second partial area 103*b*. Thus, the line 1*a* has a portion that crosses the boundary line 110 from the second partial area 103*b* into the first partial area 103*a*, and a portion that crosses the boundary line 110 from the first partial area 103*b* into the second partial area 103*b*. Owing to this feature of the boundary line 110, in the event of deviation of the first pass and the second pass in the sub-scanning direction during partial overlap printing, for example, gaps will open up between the first partial area 103*b* and the second partial area 103*b* in portions of some of the line segments 100*a* to 100*d*, while the first partial area 103*b* and the second partial area 103*b* will overlap in portions of other line segments. For this reason, the first partial area 103*b* and the second partial area 103*b* neither unilaterally spread apart nor overlap, and therefore noticeable differences in color shade do not readily arise between non-overlap printed areas, for example, the area P102 (FIG. 3) versus the partial overlap area P103. It is not necessary for all areas of the line 1*a* in the main scanning direction to have the above feature (i.e., of having a portion in which the line 1*a* crosses the boundary line 110 from the second partial area 103*b* into the first partial area 103*a*, and a portion that crosses the boundary line 110 from the first partial area 103*b* into the second partial area 103*b*), and, optionally, only some of the areas need have the above feature.

In the present embodiment, the configuration shown in FIG. 8B is a single unit; on the printing medium P, a plurality of these single units are lined up side by side in the main scanning direction. Specifically, the first and second triangles 120, 130 shown in FIG. 8A or FIG. 8B appear at given periodicity (frequency). In preferred practice, the frequency f2 of appearance of the second triangles 130 appear is greater than the frequency f1 of appearance of the first triangles 120. By so doing, it is possible for second triangles 130 to disperse continuity by the first triangles 120 in the main scanning direction or in a direction diagonal to the sub-scanning direction. As a result, whereas in the absence of the second triangles 130, the first partial area P103*b* and the second partial area P103*b* would either spread apart or overlap along the entire line segment 100*e* as shown in FIG. 6 (B-2) or (B-3), according to the present embodiment, the first partial area P103*b* and the second partial area P103*b* spread apart only in portions of a few of line segments 100*a* to 100*d* which are shorter than the line segment 100*e*, while the first partial area P103*b* and the second partial area P103*b* overlap in portions of the other segments, as shown in FIG. 6 (A-2) or (A-3). Consequently, noticeable difference in color shade between the area P102 (FIG. 3) and the partial overlap printed area P103 may be avoided. The size (amplitude) of the second triangles 130 in the sub-scanning direction is preferably smaller than the size (amplitude) of the first triangles 120 in the sub-scanning direction.

On the boundary line 110, let the boundary of line segments 110*a* and 110*b* be denoted as P4, and the boundary of line segments 110*c* and 110*d* as P5. A line lh4 is drawn in the sub-scanning direction through point P4, and another line lh5 is drawn perpendicular to the sub-scanning direction through point P5. The angle formed by the line lh4 and the line segment 110*b* may be greater than 45 degrees ($\pi/4$) but less than 90 degrees ($\pi/2$), and the angle formed by the line lh5 and the line segment 110*c* may be greater than 0 degrees but less than 45 degrees. This minimizes the likelihood of streaks appearing in the main scanning direction or sub-scanning direction.

Figure 9:
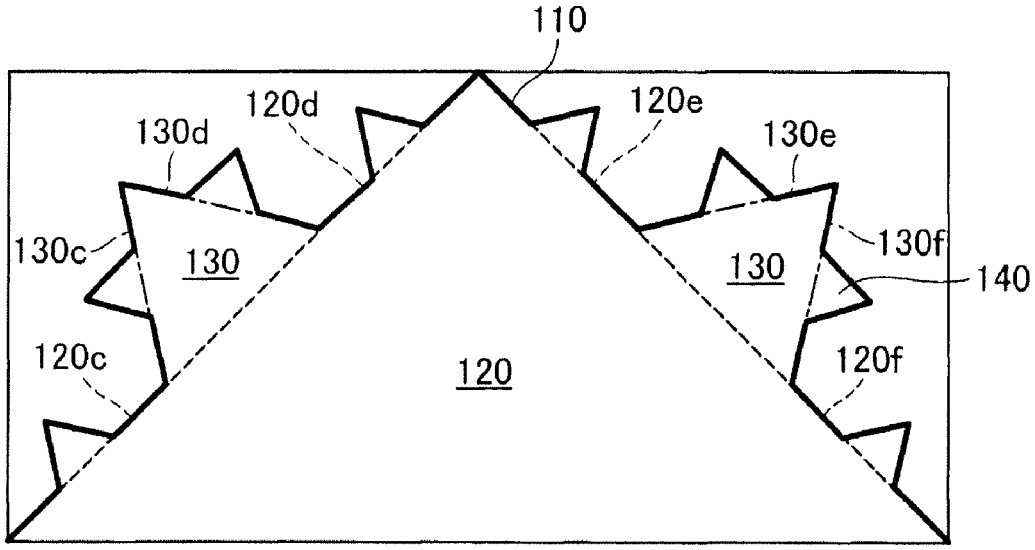
FIG. 9 is a drawing showing a modified example of a boundary line.

FIG. 9 is a drawing showing a modified example of a boundary line. The boundary line shown in FIG. 9 further includes third triangles 140 which are disposed on the line segments 120*c*, 130*c*, 130*d*, 120*d*, 120*e*, 130*e*, 130*f*, and 120*f* of the example shown in FIGS. 8A and 8B, and forms substantially star shaped contours defined by portions of oblique sides that belong to the three triangles 120, 130, 140 but that do not overlap sides of other triangles 120, 130, 140. Optionally, even smaller triangles may be added.

Figure 10A:
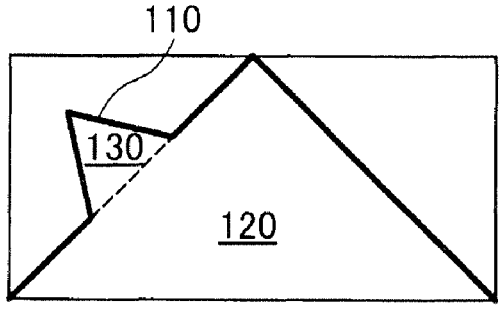
FIGS. 10A to 10D are drawings showing modified examples of boundary lines.
Figure 10B:
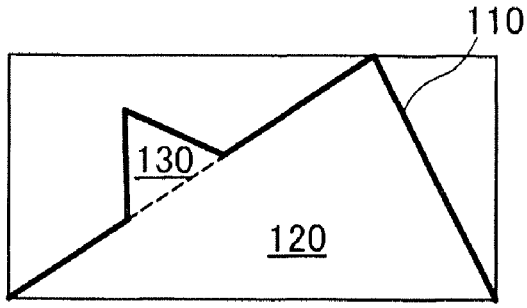

FIGS. 10A to 10D are drawings showing modified examples of boundary lines. In the following modified example, variations of the triangle shapes that define the boundary line 110 are shown. In the preceding embodiment, second triangles 130 are respectively disposed on oblique sides of the first triangle 130; but may instead be disposed on one oblique side only, as shown in FIG. 10A. Provided that a second triangle is present on at least one oblique side of the first triangle 120, it is possible to avoid noticeable difference in color shading between the area P103 that is printed in the second pass and the area P102 or P104 that is printed in the first pass, arising from deviation in the main scanning direction or sub-scanning direction. Optionally, the first triangle 120 is a non-equilateral triangle as shown in FIG. 10B. Even where the first triangle 120 is a non-equilateral triangle, provided that a second triangle is present on an oblique side thereof, it is possible to avoid noticeable difference in color shading between the area P103 that is printed in the second pass and the area P102 or P104 that is printed in the first pass, arising from deviation in the main scanning direction or sub-scanning direction.

Figure 10C:
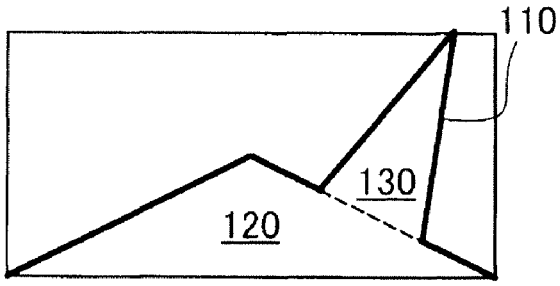
Figure 10D:
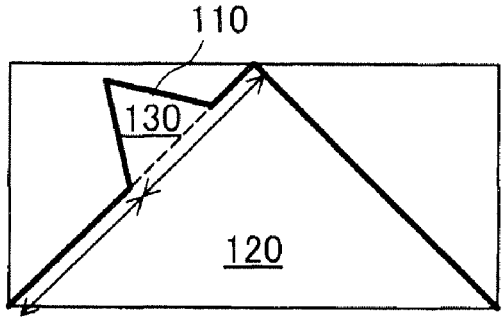

As shown in FIG. 10C, the first triangle 120 may be reduced in height, and the height of the second triangle 130 may be greater than the height of the first triangle. By so doing it is possible to bring the added surface area of the first and second triangle 120, 130 added into substantial equality with the remaining surface area, and possible to match the number of pixel rows printed in the first pass with the number of pixel rows printed in the second pass. Also, the placement location of the second triangle 130 may be shifted along an oblique side of the first triangle 120 relative to the center part of the oblique side, as shown in FIG. 10D.

Figure 11A:
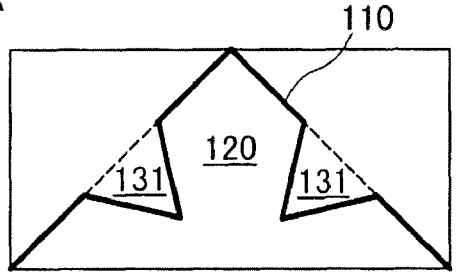
FIGS. 11A to 11C are drawings showing modified examples of boundary lines.
Figure 11B:
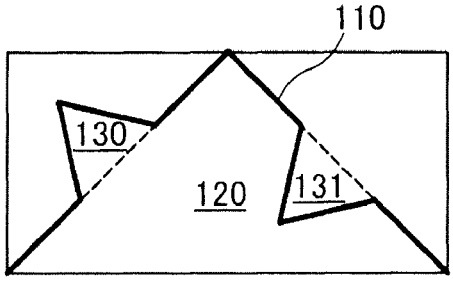
Figure 11C:
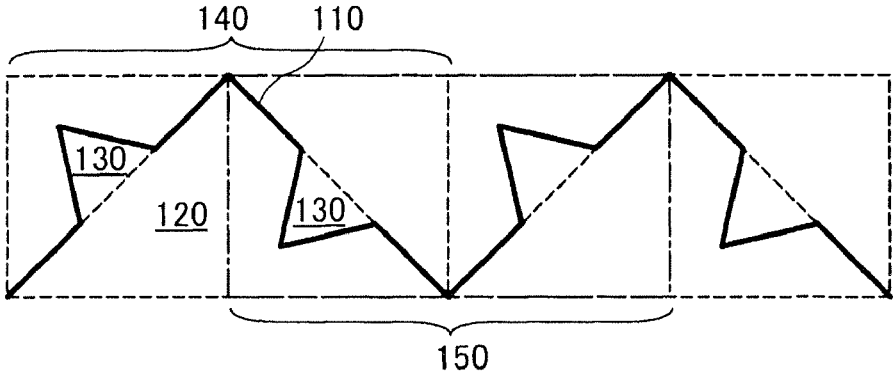

FIGS. 11A to 11C are drawings showing modified examples of boundary lines. In the preceding embodiment and modification examples, the second triangle 130 is added as a protrusion on the first triangle 120, however, in a converse arrangement, a second triangle 131 may be subtracted to create a recession instead of a protrusion. FIG. 11A depicts a second triangle 131 provided as a recession of the first triangle 120. FIG. 11B depicts the first triangle 120 provided with a second triangle 130 as a protrusion and with another second triangle 131 as a recession. FIG. 11C shows the pattern of FIG. 11B lined up side by side in the main scanning direction. In this case, two constituent units 140, 150 may be contemplated. Considered in terms of symmetry, these two constituent units 140, 150 are congruous. As a result, it is possible for the areas P103*a*, P103*b* to have equal surface area.

Figure 12:
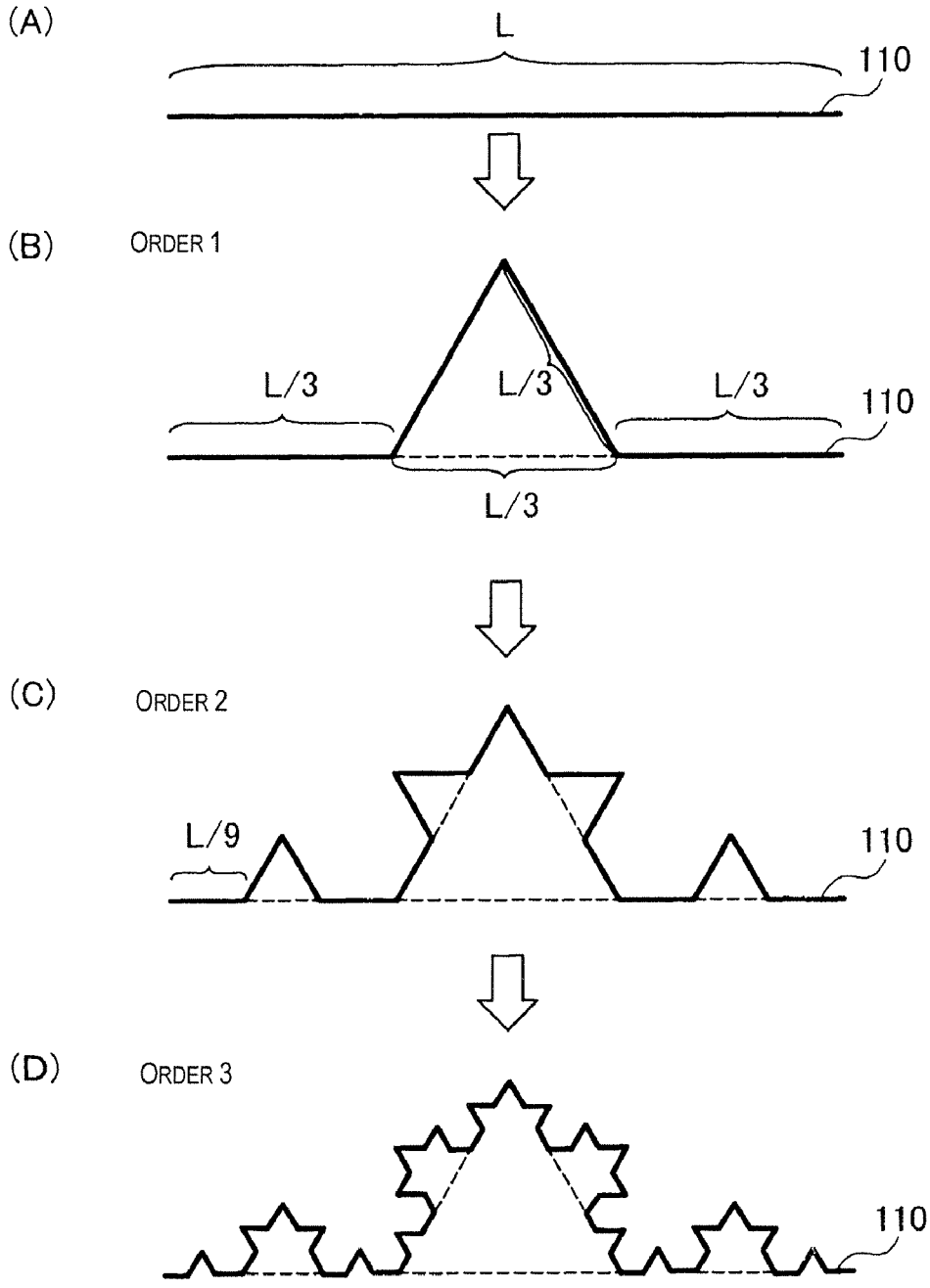
FIG. 12 is a drawing showing an example of an instance using the Koch curve to form a portion printed by upstream nozzles and a portion printed by downstream nozzles.

FIG. 12 is a drawing showing an example of an instance using the Koch curve to form a portion printed by upstream nozzles and a portion printed by downstream nozzles. Optionally, the boundary line 110 may be a Koch curve. The Koch curve is one type of fractal pattern, specifically, a pattern obtained by repeating to infinity a process of dividing a line segment into three equal parts and constructing an equilateral triangle having two of the division points as apices. FIG. 12 (B) shows one iteration of division of a line segment into three equal parts and construction of an equilateral triangle having two of the division points as apices (order 1), FIG. 12 (C) shows two iterations (order 2), and FIG. 12 (D) shows three iterations (order 3). As division of a line segment into three equal parts and construction of an equilateral triangle having two of the division points is repeated to infinity, the length of the line segment becomes infinitely great. If the order is too low, it is difficult to form a boundary line 110 such that in portions of some line segments defining the boundary line 110 the first partial area P103*b* and the second partial area P103*b* spread apart, while in portions of other line segments the first partial area P103*b* and the second partial area P103*b* overlap. Higher orders necessitate greater numbers of the upstream nozzles 91 and the plurality of downstream nozzles 93. Consequently, for the purposes of implementation in the present embodiment, it is preferable to use an order of 2 to 4, especially an order of 2 or 3. Other fractal patterns besides the Koch curve, such as the Hilbert curve, may be used for the boundary line 110 as well. Because fractal shapes have self-similarity, it is possible to disperse gaps and overlap between the areas 103*a* and 103*b*.

Figure 13:
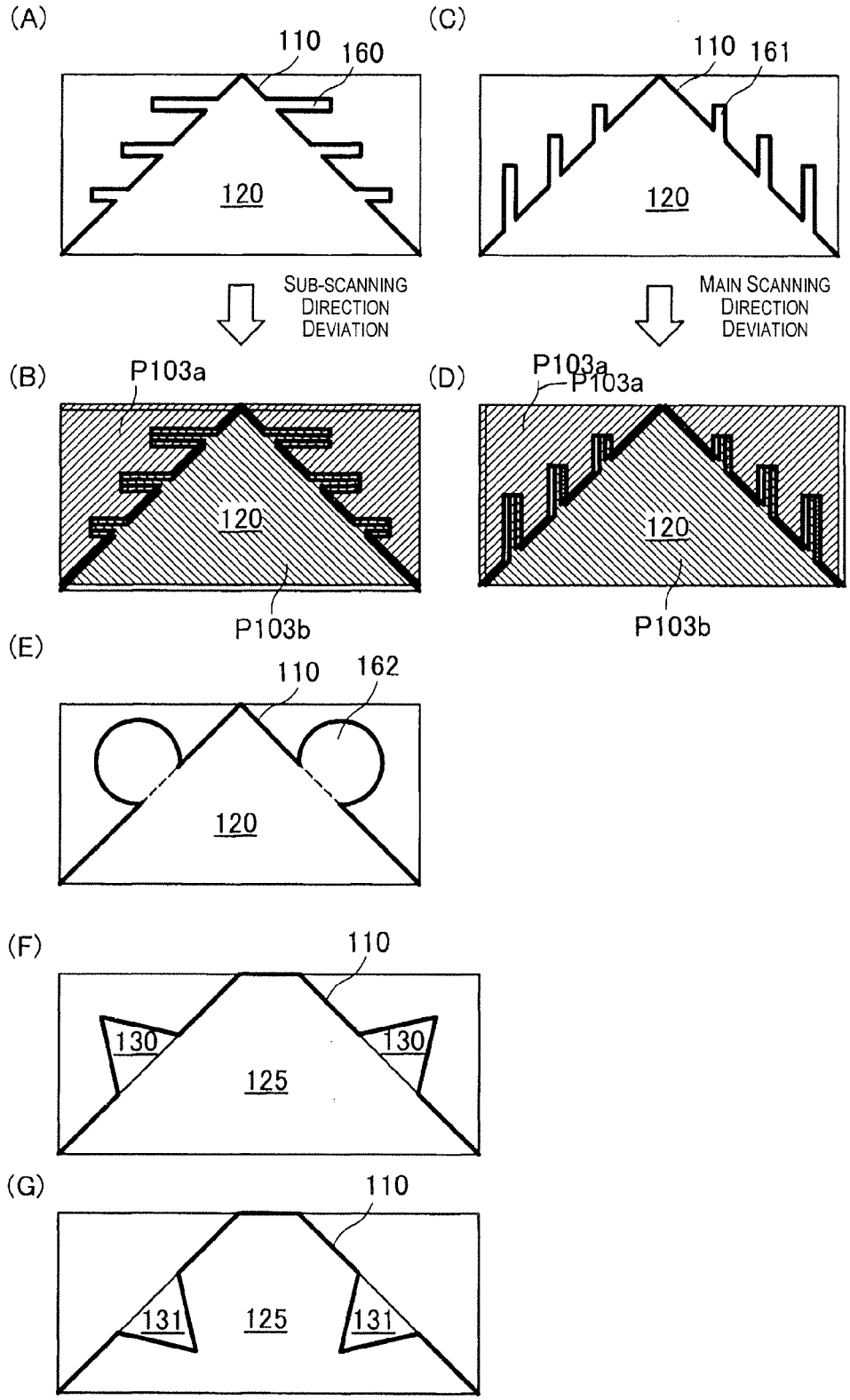
FIG. 13 is a drawing showing other modified examples of boundary lines.

FIG. 13 is a drawing showing other modified examples of boundary lines. Whereas the boundary lines 110 discussed above are all based on combinations of triangle shapes, triangles may be combined with other shapes. The boundary line 110 shown in FIG. 13 (A) has a shape produced by adding bands 160 that are parallel to the main scanning direction to a triangle 120. By so doing, the area P103 and the area P102 or P104 will readily appear to have substantially identical color, even with deviation of the areas P103*a* and P103*b* in the sub-scanning direction, as shown in FIG. 13 (B). The boundary line 110 shown in FIG. 13 (C) has a shape produced by adding bands 161 that are parallel to the sub-scanning direction to a triangle 120. By so doing, the area P103 and the area P102 or P104 will readily appear to have substantially identical color, even with deviation of the areas P103*a* and P103*b* in the main scanning direction, as shown in FIG. 13 (D).

FIG. 13 (E) depicts addition of circles 162 to a triangle 120. Where circles are used, with deviation of the areas P103*a* and P103*b* in either direction, some of the portions tangent to the circles will spread apart to form gaps, while others will overlap, and therefore the gaps and overlap tend to cancel out so that the area P103 and the area P102 or P104 appear to have substantially identical color.

FIGS. 13 (F) and (G) depict the use of a trapezoid 125 instead of a triangle 120. FIG. 13 (F) depicts addition of triangles 130 as protrusions to oblique sides of the trapezoid 125, while FIG. 13 (G) depicts subtraction of triangles 131 from oblique sides of the trapezoid 125 to create recessions. With such combinations of a trapezoid 125 with triangles 130 or 131 it is likewise possible for the area P103 and the area P102 or P104 to appear to have substantially identical color.

Figure 14A:
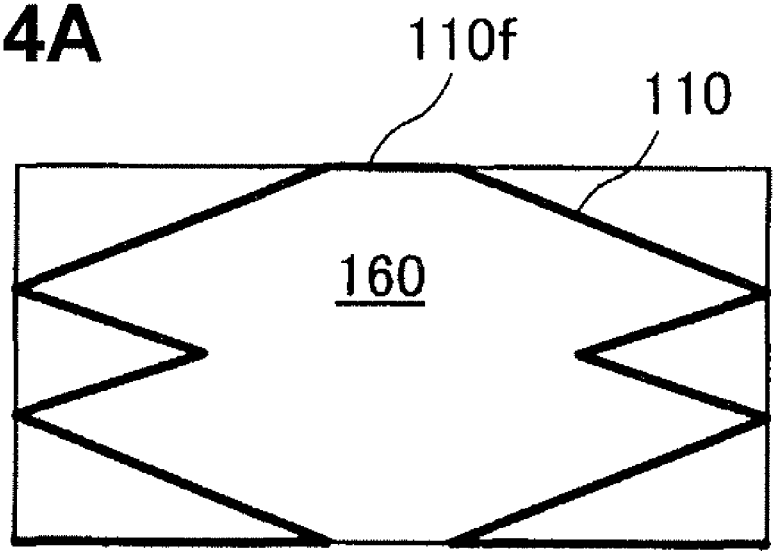
FIGS. 14A and 14B are drawings showing other modified examples of boundary lines.
Figure 14B:
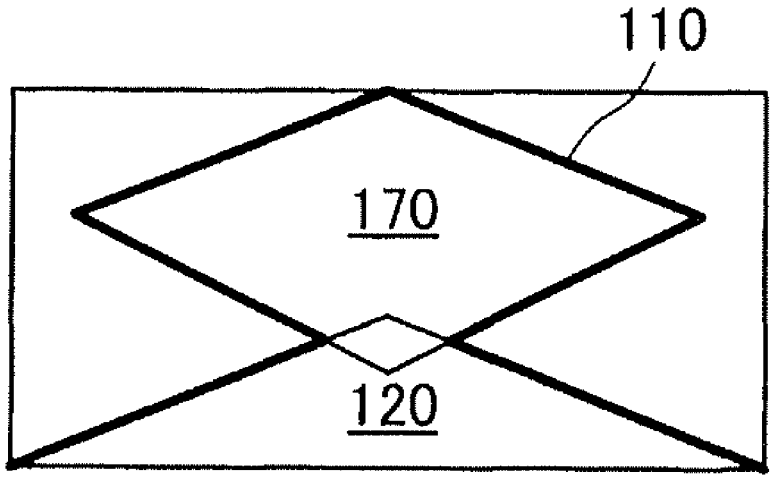

FIGS. 14A and 14B are drawings showing other modified examples of boundary lines. FIG. 14A shows a combination of two squares. FIG. 14B shows a combination of a triangle and a square. The boundary line 110 may have shapes such as these as well.

The boundary lines 110 discussed up to this point are single continuous lines. Here, a single continuous line means a line that could be drawn with a single continuous stroke, without intersection. The boundary line 110 may continue on through the boundary of the area 102 and the area 103, or the boundary portion of the area 102 and the area 103. For example, in the case of the boundary line 110 shown in FIG. 14A, the line segment 110*f* is the boundary portion of the area 102 and the area 103, and the line continues on through this portion.

According to the present embodiment, the printer 20 is provided with a plurality of ink cartridges 82 to 87 and has a plurality of nozzle rows. In this instance, different partial overlap masks 200 may be used for different individual colors. Because dispersion can be made to differ for different individual colors, it is possible to increase the likelihood that the area P103 will appear to be the same color as the area P102 or the area P104. Moreover, while the present embodiment describes an example of an inkjet system printer, implementation is possible in non-inkjet system printers, such as laser printers, as well.

According to the present embodiment, the line 1*a* that is parallel to the sub-scanning direction has a portion that crosses the boundary line 110 from the second partial area P103*b* to the first partial area 103*a*, and a portion that crosses the boundary line 110 from the first partial area P103*b* to the second partial area 103*b*; however, optionally, a line that is orthogonal to the sub-scanning direction (a line parallel to the main scanning direction) has a portion that crosses the boundary line 110 from the second partial area P103*b* to the first partial area 103*a*, and a portion that crosses the boundary line 110 from the first partial area P103*b* to the second partial area 103*b*. By so doing, it is possible to make the area P103 appear substantially the same color as the area P102 or the area P104, even if deviation arises in the main scanning direction.

In the preceding description, there are given examples of the boundary line 110 being based on straight lines such as triangles or trapezoids, but optionally, the boundary line 100 may be based on curved lines. For example, the boundary line 110 may have a shape that includes a Takagi curve (Blancmange curve), a de Rham curve, or part of a Mandelbrot set shape.

While the present invention has been shown herein on the basis of certain preferred embodiments, these embodiments are intended to aid in understanding of the invention and should not be construed as limiting the invention. Various modifications and improvements are possible without departing from the spirit of the invention as set forth in the appended claims, and these equivalents shall be considered to fall within the scope of the invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device for executing band printing using a printing material, the printing device comprising:

a print head having a plurality of nozzles;

a main scanning direction drive mechanism configured and arranged to move the print head and a printing medium relative to each other in a main scanning direction during the band printing;

a sub-scanning direction drive mechanism configured and arranged to move the print head and the printing medium relative to each other in a sub-scanning direction; and a control portion configured to execute partial overlap printing for printing an overlap printed area constituting a portion of each band in a plurality of main scanning passes, the overlap printed area being divided by a single continuous boundary line into a first area that is printed by upstream nozzles among the plurality of nozzles, and a second area that is printed by downstream nozzles among the plurality of nozzles, and the boundary line including a first boundary line portion where a parallel line extending parallel to the sub-scanning direction crosses the boundary line from the first area into the second area, and a second boundary line portion where the parallel line crosses from the second area into the first area.

2. The printing device according to claim 1, wherein the boundary line has asperities with a low-frequency component and a high-frequency component with respect to the main scanning direction.

3. The printing device according to claim 2, wherein an amplitude of the high-frequency component of the asperities is smaller than an amplitude of the low-frequency component.

4. The printing device according to claim 1, wherein the boundary line is formed along a contour of a polygonal shape that is formed by a combination of a first triangle having a base side parallel to the main scanning direction, and a second triangle smaller than the first triangle and having as a base side a portion of an oblique side of the first triangle.

5. The printing device according to claim 4, wherein one of two oblique sides of the second triangle intersects the main scanning direction at an angle of more than 0 degree and less than 45 degrees, while the other of the two oblique sides intersects the main scanning direction at an angle of more than 45 degrees and less than 90 degrees.

6. The printing device according to claim 1, wherein the boundary line includes a Koch curve portion or a fractal shape portion.

7. The printing device according to claim 1, wherein the boundary line includes a portion where a second parallel line extending parallel to the main scanning direction crosses the boundary line from the first area into the second area, and a portion where the second parallel line crosses from the second area into the first area.

8. A printing device for executing band printing using a printing material, the printing device comprising:

a print head having a plurality of nozzles;

a main scanning direction drive mechanism configured and arranged to move the print head and a printing medium relative to each other in a main scanning direction during the band printing;

a sub-scanning direction drive mechanism configured and arranged to move the print head and the printing medium relative to each other in a sub-scanning direction; and a control portion configured to execute partial overlap printing for printing an overlap printed area constituting a portion of each band in a plurality of main scanning passes with the overlap printed area being divided by a single continuous boundary line into a first area that is printed by upstream nozzles among the plurality of nozzles, and a second area that is printed by downstream nozzles among the plurality of nozzles; and the boundary line including a first boundary line portion where a parallel line extending parallel to the main scanning direction crosses the boundary line from the first area into the second area, and a second boundary line portion where the parallel line crosses from the second area into the first area.

9. A printing method comprising:

printing a first band in a first pass; and printing a second band in a second pass so that the second band partially overlaps the first band for from an overlap printed area, the overlap printed area being divided by a single continuous boundary line into a first area that is printed during the first pass and a second area that is printed during the second pass, the boundary line including a first boundary line portion where a parallel line extending parallel to a sub-scanning direction crosses the boundary line from the first area into the second area and a second boundary line portion where the parallel line crosses from the second area into the first area.

* * * * *